US011970352B2

(12) United States Patent
Leskinen

(10) Patent No.: US 11,970,352 B2
(45) Date of Patent: Apr. 30, 2024

(54) BRAKE OF AN IDLER ROLL OF A FIBER WEB MACHINE, IN PARTICULAR OF A SLITTER-WINDER

(71) Applicant: Valmet Technologies Oy, Espoo (FI)

(72) Inventor: Arto Leskinen, Järvenpää (FI)

(73) Assignee: Valmet Technologies Oy, Espoo (FI)

( * ) Notice: Subject to any disclaimer, the term of this patent is extended or adjusted under 35 U.S.C. 154(b) by 301 days.

(21) Appl. No.: 17/668,279

(22) Filed: Feb. 9, 2022

(65) Prior Publication Data

US 2022/0267113 A1 Aug. 25, 2022

(30) Foreign Application Priority Data

Feb. 11, 2021 (FI) ..... 20215138

(51) Int. Cl.
*B65H 27/00* (2006.01)
*D21G 1/02* (2006.01)

(52) U.S. Cl.
CPC ..... *B65H 27/00* (2013.01); *D21G 1/02* (2013.01); *B65H 2301/4148* (2013.01); *B65H 2403/7254* (2013.01); *B65H 2555/13* (2013.01)

(58) Field of Classification Search
CPC ..... B65H 27/00; B65H 26/025; B65H 2403/7254; B65H 2555/13; F16D 49/00; F16D 63/002
See application file for complete search history.

(56) References Cited

U.S. PATENT DOCUMENTS 3,841,580 A 10/1974 Rodach
4,347,962 A 9/1982 Uphues
4,788,463 A * 11/1988 Layh ..... F16D 51/00 188/161
4,958,780 A * 9/1990 Bruenn ..... B65H 59/04 242/470
5,234,177 A * 8/1993 Maji ..... B65H 23/066 242/421.4
6,357,691 B1 * 3/2002 Watanabe ..... H02K 49/106 242/909
7,017,849 B2 * 3/2006 Fuchs ..... B65H 26/025 242/419.9
7,114,674 B2 * 10/2006 Fuchs ..... B65H 26/025 242/419.9

(Continued)

FOREIGN PATENT DOCUMENTS

WO 2001135175 A1 11/2011

OTHER PUBLICATIONS

Finnish Patent and Registration Office, Communication of Acceptance and Search Report for FI 20215138, dated Sep. 10, 2021.

(Continued)

*Primary Examiner* — Sang K Kim
(74) *Attorney, Agent, or Firm* — Stiennon & Stiennon

(57) ABSTRACT

A brake is provided for an idler roll (10) of a fiber web machine, in particular of a slitter-winder, which idler roll (10) has an outer shell surface (13). The brake (20) is located outside the outer shell surface (13) of the idler roll (10) in close vicinity of the idler roll (10) in a non-contacting position. The brake (20) has a permanent magnet (25), which is configured to be moved from non-braking position to a braking position and vice versa by an actuator or cylinder (35, 45).

18 Claims, 3 Drawing Sheets

(56) References Cited

U.S. PATENT DOCUMENTS

| | | | | |
|---|---|---|---|---|
| 2004/0182965 | A1 | 9/2004 | Fuchs et al. | |
| 2006/0006271 | A1 | 1/2006 | Fuchs et al. | |
| 2015/0041514 | A1* | 2/2015 | Hachtmann ..... | B65H 27/00<br>242/538 |
| 2016/0311642 | A1 | 10/2016 | Blair et al. | |

OTHER PUBLICATIONS

Third Office Action issued by CNIPA (China National Intellectual Property Administration) for Chinese Application No. 202210124322.1, dated Feb. 20, 2024.

* cited by examiner

BRAKE OF AN IDLER ROLL OF A FIBER WEB MACHINE, IN PARTICULAR OF A SLITTER-WINDER

CROSS REFERENCES TO RELATED APPLICATIONS

This application claims priority on Finnish Application No. 20215138, filed Feb. 11, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates in general to slitter-winders for winding longitudinally slit paper and board webs into customer rolls and to braking idler rolls. Especially the invention relates to a brake for an idler roll of a slitter winder.

It is known that a fiber web, e.g., paper, is manufactured in machines which together constitute a paper-manufacturing line which can be hundreds of meters long. Modern paper machines can produce over 450,000 tons of paper per year. The speed of the paper machine can exceed 2,000 m/min and the width of the paper web can be more than 11 meters.

In paper-manufacturing lines, the manufacture of paper takes place as a continuous process. A paper web completing in the paper machine is reeled by a reel-up around a reeling shaft i.e., a reel spool into a parent roll the diameter of which can be more than 5 meters and the weight more than 160 tons. The purpose of reeling is to modify the paper web manufactured as planar to a more easily processable form. On the reel-up located in the main machine line, the continuous process of the paper machine breaks for the first time and shifts into periodic operation.

The web of parent roll produced in paper manufacture is full-width and even more than 100 km long so it must be slit into component webs with suitable width and length for the customers of the paper mill and wound around winding cores into so-called customer rolls before delivering them from the paper mill. This slitting and winding up of the web takes place as known in an appropriate separate machine i.e. a slitter-winder.

On the slitter-winder, the parent roll is unwound in an unwinding section, the wide web is slit on a slitting section into several narrower component webs which are wound up on a winding section around winding cores, such as spools, into customer rolls. When the customer rolls are completed, the slitter-winder is stopped and the wound rolls i.e. the so-called set is removed from the machine and new winding cores for new component web rolls are to be transferred to winding stations for winding a new set of component web rolls. Then, the process is continued with the winding of a new set. These steps are repeated periodically until paper runs out of the parent roll, whereby a parent roll change is performed and the operation starts again as the unwinding of a new parent roll.

Slitter-winders employ winding devices for winding the customer rolls of different types depending, inter alia, on the type of the fiber web being wound. On slitter-winders of the two drum winder type, the web is guided from the unwinding via guide rolls to the slitting section, where the web is slit into component webs, which are further guided via guide rolls to the winding (support or carrier) drum of the two drum winder and slit component webs are wound around a winding core on support of the winding drums. On slitter-winders of the multistation winder type, the web is guided from the unwinding via guide rolls to the slitting section, where the web is slit into component webs, which are further guided via guide rolls to the winding drum/drums on the winding stations to be wound up onto winding cores into customer rolls. Adjacent component webs are wound up on different sides of the winding drum/drums. Multistation winders have one to three winding drums and in them each component web is wound to a component web roll in its own winding station.

In slitter-winders, as also generally in fiber web machines, the guide rolls may comprise a drive for rotating the guide roll or the guide rolls can be idler rolls i.e., without a drive and are freely rotating. While the fiber web runs over an idler roll, it rotates by effect of draw of the fiber web and rotating speed is defined by running speed of the fiber web. In slitter-winders and in fiber web machines, sometimes web breaks occur, which causes the idler roll to remain freely rotating until it finally stops, typically only after several, even after 20, minutes. This causes losses in production time as it is necessary to wait until the idler roll stops before the slitter-winder or other section or device of a fiber web machine can be restarted. Additionally, in some cases in connection of the web breaks broke is caused and it is necessary to manually clean out the broke. In this situation, freely rotating, even with rotating speeds of several thousand rounds per minute, idler rolls cause significant work safety risks.

In slitter-winders and in fiber web machines it is known to use so-called segmented rolls, which comprise more than one, typically several segments of roll of which the roll is constructed. Often the segmented rolls are adjustable in view of the degree of curvature in the length direction of the roll, i.e., bow of the roll can be adjusted for using the roll as a spreader roll. These segmented rolls are typically idler rolls.

The idler rolls are supported at both ends on bearings on a mounting or similar support frame. The segmented rolls are typically supported on bearings on a mounting or similar support frame at ends and between the segments or the roll.

It is known from the prior art that idler rolls may have a brake for stopping the free rotational movement in case of a web break or like situation otherwise causing the idler roll to rotate freely.

In WO patent application publication 2011/135175 A1 is disclosed a stopping device for a segmented roll in a fiber web machine for assisting the stopping of the rotation of one or more roll segment(s) of the segmented roll, which stopping device comprises at least one braking device, by means of which the roll segment can be stopped, and at least one surface contact member, which surface contact member is connected to said braking device, and that the stopping device further comprises actuators for optionally bringing/releasing the surface contact member into/from surface contact with the shell of one or more roll segment(s). In these kinds of stopping devices i.e., brakes, which contact the surface of the roll to be stopped, one disadvantage is that the contacting surfaces are susceptible to wear. Thus, the brakes need maintenance and changes at regular intervals.

In US patent application publication US 2004/0182965 A1 is disclosed an idler roll in a paper handling machine, comprising: a paper web, passing through the paper handling machine; at least one idler roll, having a cylindrical shell positioned so that the paper web contacts the roll, the at least one idler roll mounted to be rotated about an axis by the action of the web of paper traveling contacting the idler roll; an electromagnet mounted closely spaced from the cylindrical shell of sufficient strength to bring the roll to a stop in less than about one minute. In US patent application publication 2006/0006271 is disclosed a paper handling machine and idler roll assembly, comprising: a paper web, passing through the paper handling machine; at least one idler roll mounted to the paper handling machine, the at least one idler roll having a cylindrical shell positioned so that the paper web contacts the cylindrical shell of the at least one idler roll, the idler roll mounted to the paper handling machine to be rotated about an axis by the paper web traveling in contact with the cylindrical shell of the idler roll; and a brake shoe mounted within the cylindrical shell, and biased by a resilient member away from engagement with an inside surface defined by the cylindrical shell; and an electromagnet positioned external to and closely spaced from the cylindrical shell, the electromagnet being operable to cause the brake shoe to engage the cylindrical shell inside surface. With these kinds of brakes, which effect the braking based on electromagnetism, a disadvantage is that the construction is complicated and thus, it is not very cost effective, especially bearing in mind that even one slitter-winder may comprise several idler rolls and especially several segmented rolls, each needing several brakes as a brake is needed for each segment of roll.

One object of the invention is to eliminate or at least minimize the above problems and disadvantages of prior art brakes of fiber web machines and in particular of slitter-winders.

A particular object of the invention is to create a non-contacting stopping device/break, which is cost effective.

SUMMARY OF THE INVENTION

To achieve the above-mentioned objects and those which come out later, the brake of the idler roll of a fiber web machine, in particular of a slitter-winder according to the invention has a permanent magnet which is configured to be moved from a non-braking position to a braking position and vice versa by an actuator.

According to the invention the brake of an idler roll of a fiber web machine, in particular of a slitter-winder, which idler roll has an outer shell surface, is located outside the outer shell surface of the idler roll in close vicinity of the idler roll in a non-contacting position and the brake has a permanent magnet, which is configured to be moved from a non-braking position to a braking position and vice versa by an actuator.

According to an advantageous feature the brake has a frame, wherein the frame has an inner hollow opening forming a chamber and a permanent magnet is movably located inside the chamber and configured to be moved from the non-braking position to the braking position and vice versa. The frame also protects an operator from contacting the moving parts of the brake.

According to an advantageous feature of the invention the actuator is a piston or plunger, and the brake is a piston brake.

According to an advantageous feature of the invention the frame is openable and has a chamber frame and a cover frame, which are configured to form the outer structure of the brake.

According to an advantageous feature of the invention the chamber frame has a cylindrical form, and the chamber also has a cylindrical from.

According to an advantageous feature of the invention the cover frame is attached to the chamber frame so it can be opened, for example by a threading.

According to an advantageous feature of the invention the brake has an inside chamber in which is located a brake support element, to which the permanent magnet element is mounted.

According to an advantageous feature of the invention the inner wall of the chamber and the outer wall of the brake support element are sealed by a seal.

According to an advantageous feature of the invention the brake has a brake support element, and the chamber has a bottom, the brake has a fluid connection configured to provide pressurized fluid, advantageously pressurized air, to the closed chamber from below the brake support element and is configured to move the brake support element and the permanent magnet inside the chamber towards the cover frame, when braking by the brake is required. The fluid connection is further configured to provide suction for removing the pressurized fluid, advantageously pressurized air, from below the brake support element for moving the brake support element and the permanent magnet inside the chamber towards the chamber bottom, when braking by the brake is not required anymore.

According to an advantageous feature of the invention the frame is polymeric material and advantageously produced by 3D printing.

According to an advantageous feature of the invention the actuator is a cylinder, advantageously a short stroke cylinder.

According to an advantageous feature of the invention the brake comprises a control device to switch the braking on and off.

According to an advantageous feature of the invention the permanent magnet is moved by a stroke movement from the non-braking position to the braking position. Advantageously the stroke is short e.g., 5-50 mm.

According to an advantageous feature of the invention the brake is a compact element and has diameter of 30-100 mm and a height of 30-100 mm.

According to an advantageous feature of the invention the brake is attached by one or more fastening devices in close vicinity of the idler roll but not contacting the idler roll.

According to an advantageous feature of the invention the distance between the brake and the idler roll is 0.1-10 mm, advantageously 0.1-2 mm, at the closest point of the operation of the brake.

According to an advantageous feature of the invention the idler roll is an aluminum roll which is a good electrical conductor so that the permanent magnet can better induce an eddy current in the rotating aluminum shell of the idler roll which produces the braking action of the brake by causing the dissipation of the kinetic energy of the idler roll and so bring it to a stop.

The invention is especially suitable to be used in connection with idler rolls of slitter-winders and in particular in connection with segmented idler rolls.

The brake of a fiber web machine, in particular of a slitter-winder according to the invention and its advantageous features is non-contacting so the brake is not susceptible to wear and need for maintenance and changing out of parts is decreased. The construction of the brake is compact and simple thus it is very cost-effective and functions securely. The brake stops the free rotational movement of the idler roll fast and thus capacity of the section, or device handling the fiber web, in the slitter-winder is increased. By use of the brake the braking time is reduced to one tenth, when compared to a situation where no brake is used.

BRIEF DESCRIPTION OF THE DRAWINGS

Aspects of the invention, however, together with additional objects and advantages thereof, will be best understood from the following description of some example embodiments when read in connection with the accompanying drawings and in the following the invention is described in more detail referring to the accompanying drawings.

DESCRIPTION OF THE PREFERRED EMBODIMENTS

During the course of this description like numbers and signs will be used to identify like elements according to the different views which illustrate the invention. Repetition of some reference signs may have been omitted in the figures for clarity reasons.

Figure 1:
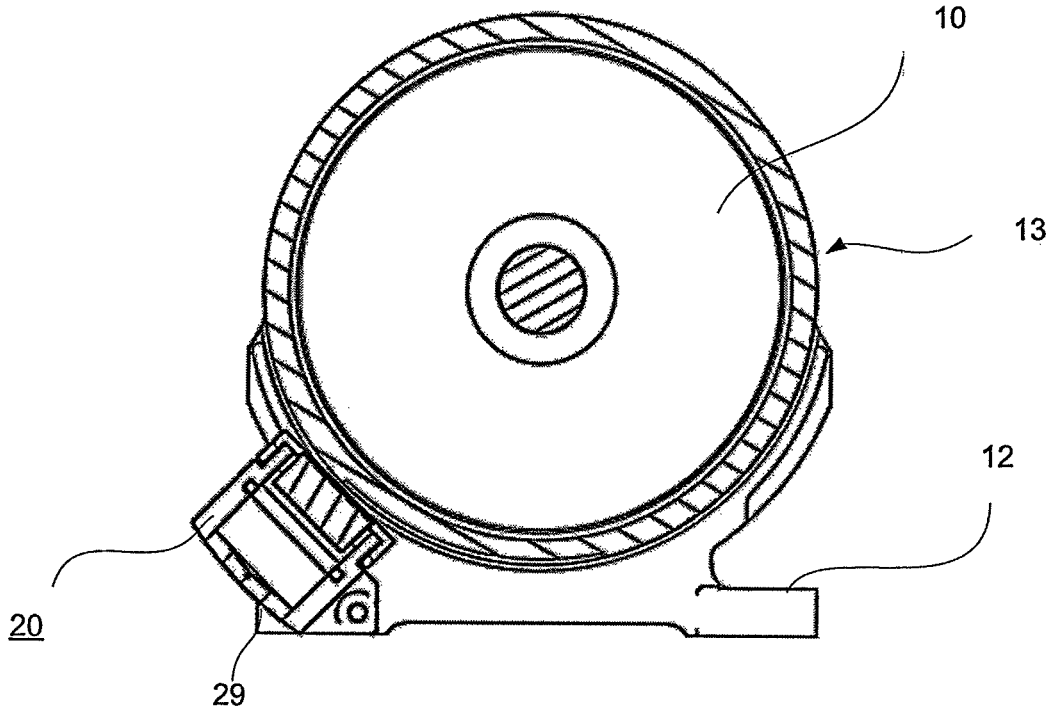
FIG. 1 is schematically shown an example of an idler roll of a slitter-winder with an advantageous example of the brake according to the invention.
Figure 1A:
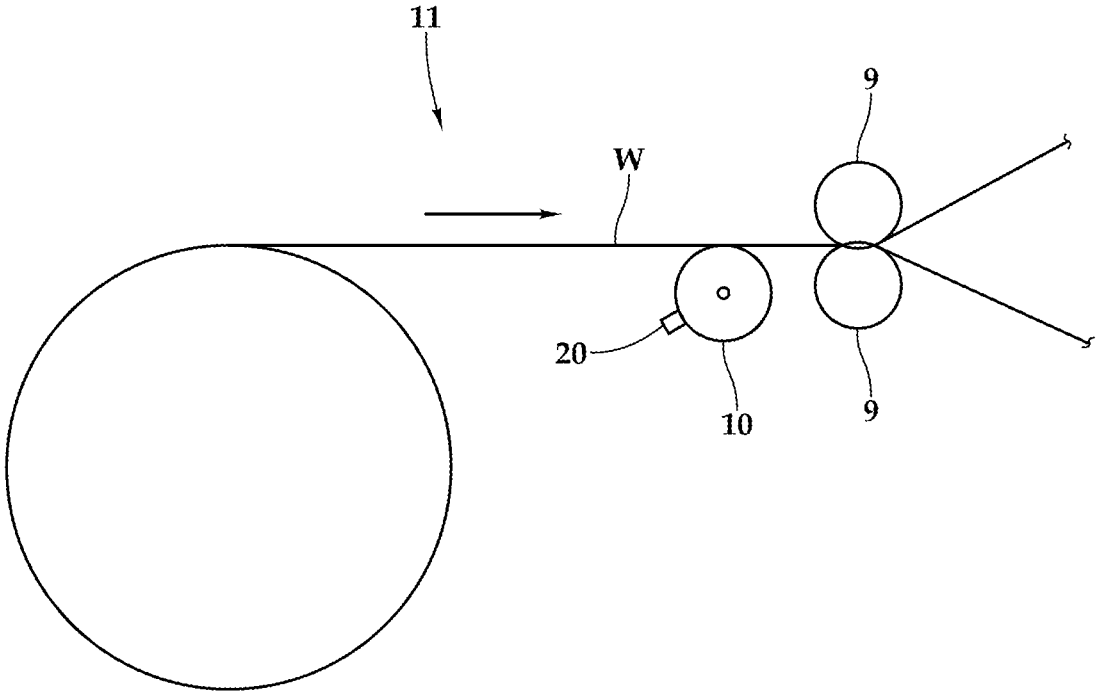
FIG. 1*a* is a schematic view of an idler roll of a slitter-winder with the brake according to the invention.

In FIGS. 1 and 4-6 is shown an idler roll 10 with a brake 20. As shown in FIG. 1*a*, the idler roll 10 is positioned within a slitter winder 11 such that a web W passes over the idler roll to be slit by blades 9 into component webs. The idler roll 10 comprises an outer shell surface 13 and a mounting frame 12, to which the brake 20 is attached by a fastener 29 such that the brake 20 is located outside the outer shell surface 13 of the idler roll 10 in close vicinity of the idler roll 10 in a non-contacting position i.e., the brake 20 is not in contact with the outer shell surface 13 of the idler roll 10. The brake 20 comprises a permanent magnet 25, which is movable from a non-braking position to a braking position and vice versa, by an actuator, which in the example of FIGS. 2-5 is a piston 35 and in the example of FIG. 6 a permanent magnet is connected by a rod 45 to a piston in a cylinder.

Figure 2:
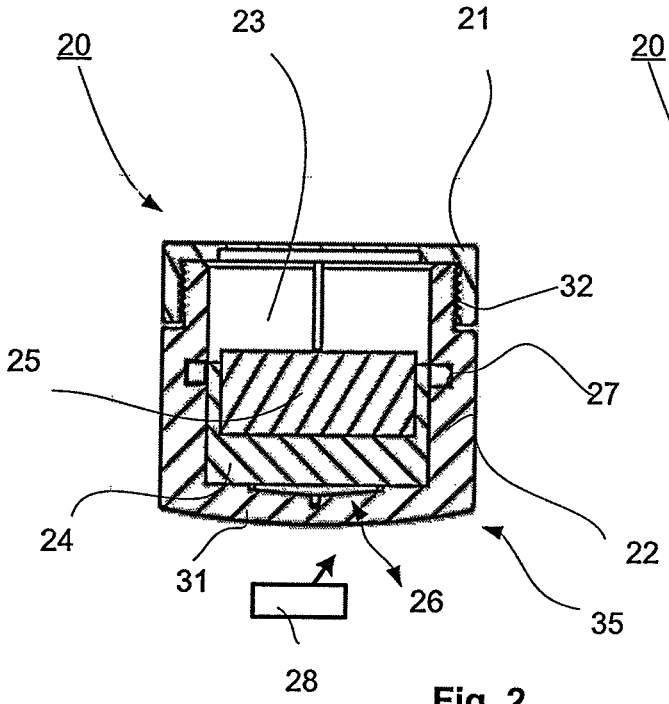
FIG. 2 is schematically shown the advantageous example of the brake according to FIG. 1, when it is not braking.
Figure 3:
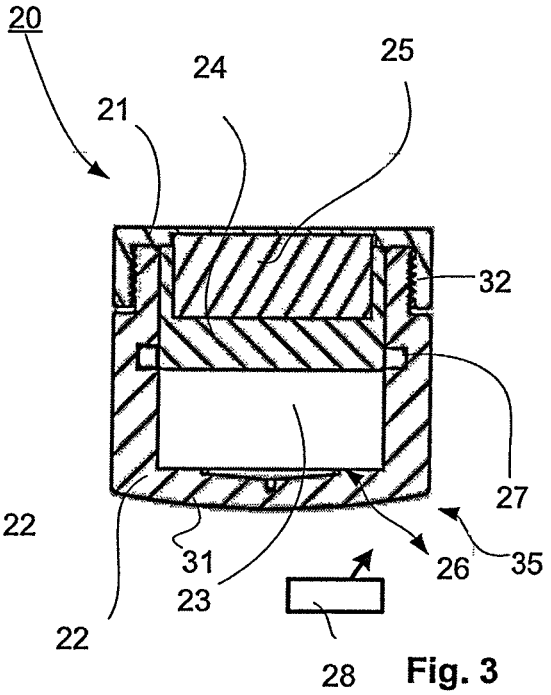
FIG. 3 is schematically shown the advantageous example of the brake according to FIGS. 1-2, when it is braking.
Figure 4:
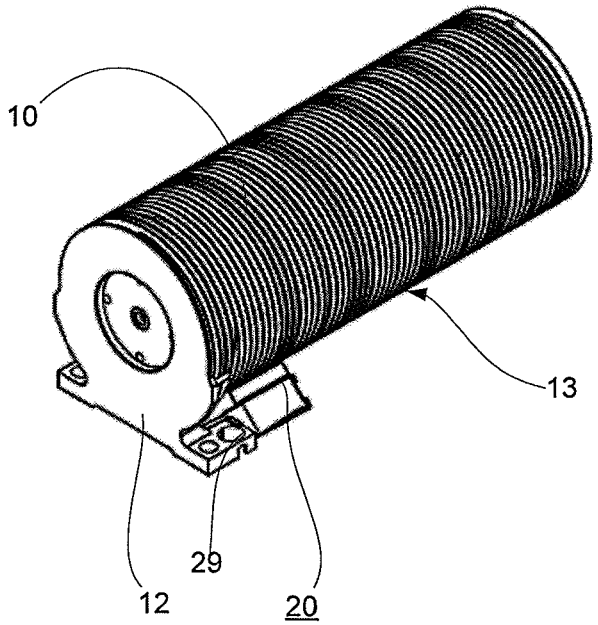
FIGS. 4 and 5 schematically shown the example of FIG. 1 as 3D views.
Figure 5:
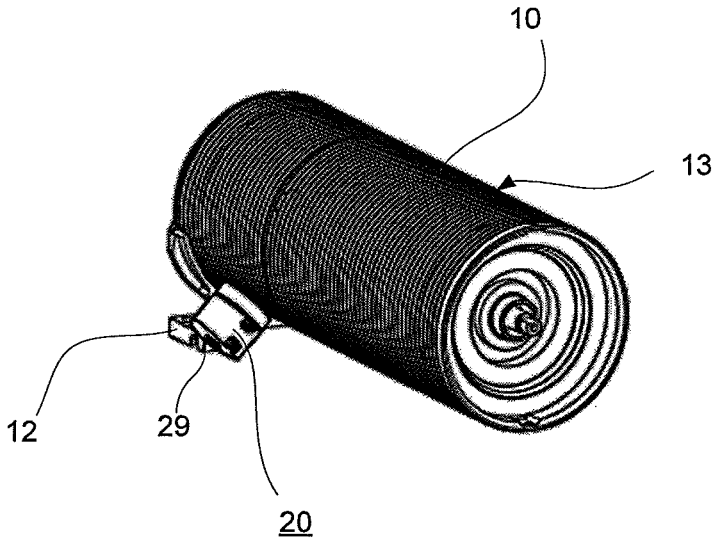

In FIG. 2 is shown the brake 20 in a non-braking position and in FIG. 3 is shown the brake 20 in a braking position. The brake 20 has a frame 21, 22, advantageously formed openable and comprising a chamber frame 22 and a cover frame 21, which form the outer structure of the brake 20. The chamber frame 22 has a cylindrical form. The cover frame 21 is openably attached to the chamber frame 22, for example by a threaded connection 32. When mounted in connection with an idler roll 10 as shown in FIGS. 1 and 4-5 the cover frame 21 of the brake 20 is towards the outer shell surface 13 of the idler roll 10.

The distance between the brake and the outer shell surface of the idler roll 10 is 0.1-10 mm, advantageously 0.1-2 mm at the closest point in the braking position.

The chamber frame 22 has inside a hollow non-though opening with a bottom 31 and a chamber 23 formed by the inside of the chamber frame 22 and the cover frame 21 closes the opening and thus, a closable chamber 23 is formed. The chamber 23 has a cylindrical form. Inside the chamber 23 is located a brake support element 24 with a permanent magnet element 25. The inner wall of the chamber 23 and the outer wall of the brake support element 24 is sealed by a seal 27 so fluid e.g., air can move the brake support element 24 and permanent magnet element 25. The brake 20 has a fluid connection 26 configured to provide pressurized fluid, advantageously pressurized air, to the closed chamber 23 from below the brake support element 24 for moving the brake support element 24 and the permanent magnet 25 inside the chamber 23 towards the cover frame 21 and thus, towards the idler roll 10 to be braked, when braking by the brake 20 is required. The fluid connection 26 is also configured to provide suction for removing the pressurized fluid, advantageously pressurized air, from below the brake support element 24 for moving the brake support element 24 and the permanent magnet 25 inside the chamber 23 towards the bottom 31 and thus, away from the idler roll 10, when braking by the brake 20 is not anymore required. In the brake 20 the permanent magnet 25 is configured to create the braking effect when moved to be in contact with the cover frame 21 of the brake 20 i.e., to the closest position in view of the outer shell surface 13 of the idler roll 10. As can be noted, the brake 20 comprises as the actuator a piston 35 and thus has advantageously a piston braking principle and is thus advantageously a piston brake 20 the braking effect is provided by the permanent magnet 25.

The brake 20 advantageously comprises control device 28 e.g., a fluid valve, to switch the braking on and off by provide the pressurized fluid into the chamber and by removing the pressurized fluid from the chamber, via the fluid connection 26.

The stroke of the permanent magnet 25 in its movement from the non-braking position to the braking position is short, advantageously 5-50 mm.

The chamber frame 22 and the cover frame 21 are advantageously of polymeric material and can be advantageously produced by 3D printing.

The brake 20 is a compact element and has diameter of 30-100 mm and height of 30-100 mm.

Figure 6:
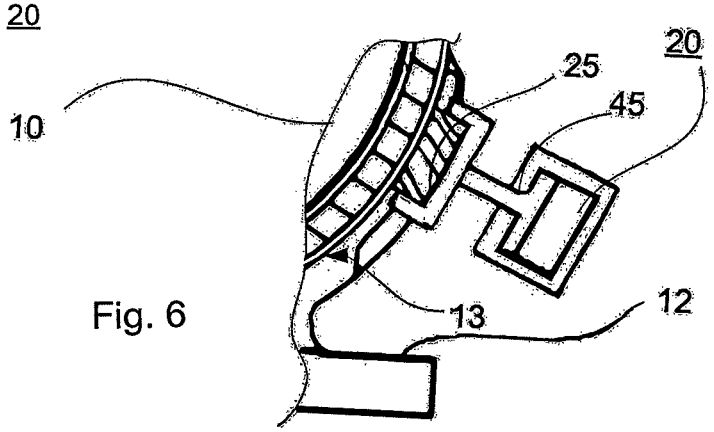
FIG. 6 is schematically shown another advantageous example of the brake according to the invention.

In FIG. 6 is shown another example of the brake 20. The brake 20 comprises the same features, fastening structures, movement principles and functions as in the above example but in this example the overall structure of the brake 20 is simplified. The brake 20 comprises the permanent magnet 25, which in this example is movable by the actuator or piston, with a cylinder 45 or actuator, advantageously a short-stroke cylinder.

In the description in the foregoing, although some functions have been described with reference to certain features, those functions may be performable by other features whether described or not. Although features have been described with reference to certain embodiments or examples, those features may also be present in other embodiments or examples whether described or not. Above the invention has been described by referring to some advantageous examples only to which the invention is not to be narrowly limited. Many modifications and alterations are possible within the invention as defined in the following claims.

I claim:

1. An idler roll brake in a fiber web machine, comprising:

an idler roll having an outer shell, the outer shell having an outer shell surface;

a brake located outside the outer shell surface of the idler roll; and wherein the brake comprises a permanent magnet arranged to be moved by an actuator from a non-braking position spaced from the outer shell surface of the idler roll to a braking position near but not in contact with the outer shell surface, the actuator also arranged to move the brake back to the non-braking position spaced from the outer shell surface.

2. The idler roll brake of claim 1 wherein the fiber web machine is a slitter-winder.

3. The idler roll brake of claim 1 wherein the brake further comprises a frame, the frame having portions defining an inner hollow opening forming a chamber; and wherein the permanent magnet is movably located inside the chamber and configured to be moved therein from the non-braking position to the braking position and back to the non-braking position.

4. The idler roll brake of claim 3 wherein the frame further comprises a chamber frame and a cover frame forming an outer structure of the brake which holds and guides the permanent magnet as the permanent magnet moves toward and away from the outer shell of the idler roll.

5. The idler roll brake of claim 4 wherein the chamber frame has a cylindrical form, and the chamber has a cylindrical form within the chamber frame.

6. The idler roll brake of claim 4 wherein the cover frame is attached to the chamber frame so as to be openable to give access to the chamber.

7. The idler roll brake of claim 4 wherein the chamber holds a brake support element to which the permanent magnet element is mounted.

8. The idler roll brake of claim 7 wherein the chamber has an inner wall, and the brake support element has an outer wall and wherein the inner wall of the chamber is sealed to the outer wall of the brake support element by a seal.

9. The idler roll brake of claim 4 wherein the brake frame is made of polymeric material.

10. The idler roll brake of claim 1 wherein in the non-braking position the permanent magnet is spaced from the outer shell surface of the idler roll a distance of 4.9 to 10 mm, and in the braking position the permanent magnet is spaced from outer shell surface a distance of 0.1 to 2 mm.

11. The idler roll brake of claim 1 wherein the actuator is a piston that moves in a cylinder.

12. The idler roll brake of claim 1 further comprising a control device arranged to switch the braking on and off by movement of the permanent magnet.

13. The idler roll brake of claim 1 wherein the permanent magnet is moved from the non-braking position to the braking position by a stroke movement of the actuator of 5-50 mm.

14. The idler roll brake of claim 1 wherein the brake has a diameter of 30-100 mm and a height of 30-100 mm.

15. The idler roll brake of claim 1 wherein the distance between the brake and the outer shell surface of the idler roll is 0.1 to 10 mm and the braking position of the brake places the permanent magnet 0.1-2 mm from the outer shell surface of the idler roll.

16. An idler roll brake in a fiber web machine, comprising:

an electrically conductive idler roll having an outer shell, the outer shell having an outer shell surface;

a brake comprising a permanent magnet located outside the outer shell surface of the idler roll; and wherein the permanent magnet is mounted for movement by an actuator to move from a position spaced at least 5 mm from the outer shell surface of the idler roll to a position where the permanent magnet interacts with the electrically conductive idler roll to stop the rotation of the electrically conductive idler roll in less than 2 minutes.

17. The idler roll brake of claim 16 wherein the idler roll is an aluminum roll and wherein the permanent magnet is mounted for movement by the actuator to move the permanent magnet to a position of 0.1 to 2 mm from the outer shell surface of the idler roll to stop the rotation of the idler roll.

18. A braking apparatus in a fiber web machine including an idler roll having an outer shell with an outer shell surface, the braking apparatus comprising:

an actuator having an extensible piston, the piston being extensible in a radial direction with respect to the idler roll; and a permanent magnet mounted to the extensible piston and spaced from the outer shell surface, the actuator arranged to move the permanent magnet on the piston between a non-braking position located a first distance from the outer shell surface to a braking position located a second distance from the outer shell surface, wherein the second distance is less than the first distance and wherein at the second distance the permanent magnet is not in contact with the outer shell surface, wherein the braking apparatus is located outside the outer shell surface of the idler roll.

* * * * *